US008328036B2

(12) United States Patent
Stevens

(10) Patent No.: US 8,328,036 B2
(45) Date of Patent: Dec. 11, 2012

(54) DOUBLE RIB OVERCAP WITH PLUG FOR A CONTAINER WITH A REMOVABLE MEMBRANE

(75) Inventor: James P. Stevens, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 1848 days.

(21) Appl. No.: 11/382,166

(22) Filed: May 8, 2006

(65) Prior Publication Data

US 2007/0257044 A1 Nov. 8, 2007

(51) Int. Cl.

| | |
|---|---|
| ***B65D 51/20*** | (2006.01) |
| ***B65D 41/16*** | (2006.01) |
| ***B65D 41/18*** | (2006.01) |
| ***B65D 39/00*** | (2006.01) |
| ***B65D 41/00*** | (2006.01) |
| ***B65D 55/02*** | (2006.01) |
| ***B65D 53/00*** | (2006.01) |

(52) U.S. Cl. ..... 220/258.1; 220/258.2; 220/782; 220/792; 215/320; 215/211; 215/351; 215/354

(58) Field of Classification Search ..... 220/258.1, 220/258.2, 782, 792; 215/320, 211, 351, 215/354

See application file for complete search history.

(56) References Cited

U.S. PATENT DOCUMENTS

| | | | | |
|---|---|---|---|---|
| 2,031,312 | A | 2/1936 | Horlick, Jr. | |
| 2,069,213 | A | 2/1937 | Carew | |
| 2,984,381 | A * | 5/1961 | Bennett | 220/780 |
| 3,516,572 | A | 6/1970 | Davis | |
| 3,572,413 | A | 3/1971 | Livingstone | |
| 3,606,074 | A | 9/1971 | Hayes | |
| 3,624,789 | A | 11/1971 | Peyser | |
| 3,880,973 | A | 4/1975 | Yoshikawa et al. | |
| 4,037,746 | A * | 7/1977 | Ver Hage | 215/45 |
| 4,042,143 | A | 8/1977 | Biggins | |
| 4,091,953 | A | 5/1978 | Daenen | |

(Continued)

FOREIGN PATENT DOCUMENTS

| | | |
|---|---|---|
| AU | 519 377 B3 | 12/1981 |

(Continued)

OTHER PUBLICATIONS

European Search Report for European Application No. 07251791.5; Filed May 8, 2006.

*Primary Examiner* — Anthony Stashick
*Assistant Examiner* — Andrew T Kirsch
(74) *Attorney, Agent, or Firm* — Alston & Bird LLP

(57) ABSTRACT

There is provided a double rib overcap with a plug for a container with a removable membrane. The skirt of the overcap includes two inside surfaces axially separated a rib. The container opening is encircled by a rim and the membrane covers the opening such that the membrane extends radially onto an outer surface of the rim. The two inside surfaces of the skirt are dimensionally sized to create an interference-fit with the rim when the overcap is connected to the container when the membrane is either attached or removed. The overcap also includes a circumferential ring radially inward of the skirt that is axially positioned to engage the top surface of the membrane when the membrane is attached to the container and is diametrically dimensioned to engage an inner wall of the container when the membrane is removed from the container.

22 Claims, 2 Drawing Sheets

U.S. PATENT DOCUMENTS

| | | | | |
|---|---|---|---|---|
| 4,561,562 | A | 12/1985 | Trombly | |
| 4,754,889 | A | 7/1988 | Debetencourt | |
| 5,253,996 | A | 10/1993 | Moore et al. | |
| 5,409,126 | A | 4/1995 | DeMars | |
| 5,678,720 | A | 10/1997 | Van Melle | |
| 6,015,061 | A | 1/2000 | Lowry | |
| 6,220,471 | B1 * | 4/2001 | Lowry | 220/258.2 |
| 6,237,791 | B1 | 5/2001 | Beck et al. | |
| 6,450,355 | B1 | 9/2002 | Lowry | |
| 6,460,759 | B1 | 10/2002 | Lowry et al. | |
| 6,877,630 | B2 | 4/2005 | Von Spreckelsen et al. | |
| 6,883,689 | B2 * | 4/2005 | Odet | 222/541.9 |
| 2002/0017501 | A1 | 2/2002 | Clements et al. | |
| 2004/0011803 | A1 | 1/2004 | D'Amato | |
| 2005/0167430 | A1 | 8/2005 | Varadarajan | |

FOREIGN PATENT DOCUMENTS

| | | | |
|---|---|---|---|
| CH | 468 286 | A | 2/1969 |
| DE | 12 98 926 | B | 7/1969 |
| DE | 32 34 848 | | 3/1984 |
| DE | 198 51 076 | A1 | 5/2000 |
| EP | 1 344 618 | A | 9/2003 |
| EP | 1 544 124 | | 6/2005 |
| EP | 1 561 696 | | 8/2005 |
| EP | 1561696 | A1 * | 8/2005 |
| FR | 2 538 349 | | 6/1984 |

* cited by examiner

DOUBLE RIB OVERCAP WITH PLUG FOR A CONTAINER WITH A REMOVABLE MEMBRANE

FIELD OF THE INVENTION

The present invention relates generally to containers with overcaps. More particularly the invention relates to overcaps for containers with a removable membrane.

BACKGROUND OF THE INVENTION

Containers that store perishable goods, such as food products, often include a sealed membrane to minimize the transfer of oxygen, moisture, or contaminants into the container. The membrane is removed by the customer when the container is first opened, and the membrane is discarded. An overcap is provided for re-closing the container after the initial opening. The overcap engages a rim (e.g., a rolled bead or a flange) on the top of the container in such a way that a snap-fit or interference-fit connection exists to retain the overcap in place on the container.

When the membrane is located directly below the overcap, both overcap and membrane provide a sealing barrier over the opening prior to the first opening of the container. Once the membrane has been removed, the overcap provides the only barrier for the remaining product during subsequent storage. Therefore, the overcap should securely connect to the container to reseal the stored product.

While a membrane is attached to a container, it often extends outwardly to the surface of the container to which the overcap attaches. In such a situation, the overcap is dimensioned to create a tight fit with the container surface and the membrane. However, once the membrane has been removed and the overcap replaced, the overcap may not create a tight fit with only the container surface because of the missing membrane. A loose fit may allow oxygen, moisture, or contaminants to enter the container or may cause the overcap to come off unintentionally.

Therefore, a need exists for an overcap for containers with membranes that provides an interference-fit when the membrane is attached and when the membrane is removed.

BRIEF SUMMARY OF THE INVENTION

The invention addresses the above needs and achieves other advantages by providing an interference-fit overcap for engaging a radially outwardly protruding rim of a container that includes a removably attached membrane. The overcap includes a top panel with a periphery, a skirt that extends from the periphery of the top panel to a distal end, and a circumferential ring that extends from the top panel in the same direction as the skirt and is radially inward of the skirt. The skirt defines a first inside surface that is axially spaced from the top panel and is proximate the distal end of the skirt. The skirt also defines a second inside surface axially positioned between the first inside surface and the top panel. The first inside surface is diametrically dimensioned to produce an interference-fit with the membrane and rim when the overcap is connected to the container with the attached membrane. The second inside surface is diametrically dimensioned to produce an interference-fit with the rim alone when the overcap is connected to the container without the membrane. The circumferential ring defines an outside surface that produces an interference-fit with an inner wall of the container when the second inside surface engages the rim of the container. Thus the present invention provides an overcap with an interference fit at both the rim and the inner wall of the container after the membrane has been removed.

The skirt of the overcap includes a first rib projecting inwardly from the skirt and axially located between the first inside surface of the skirt and the distal end of the skirt. The skirt also includes a second rib projecting inwardly from the skirt and axially located between the second inside surface and the first inside surface. When the overcap is connected to the container with the attached membrane such that the membrane and rim create an interference-fit with the first inside surface, the first rib engages beneath the rim of the container to resist detachment of the overcap. The circumferential ring also includes a distal end opposite the top panel that engages the membrane to increase the stability of the overcap and prevents the overcap from being pressed onto the container to such an extent that the rim is damaged by the second rib. When the overcap is connected to the container without the attached membrane such that the second inside surface creates an interference-fit with the rim, the second rib engages beneath the rim of the container to resist detachment of the overcap and to provide a seal, while the circumferential ring creates an interference-fit with the inner wall of the container to produce an additional interference fit to further seal the container.

The present invention also provides a container with a membrane and an overcap. The container includes a container body formed by a wall, where the wall defines an opening encircled by a radially outwardly protruding rim. The membrane is removably attached to the container to substantially cover the opening while the membrane is attached. The overcap includes a skirt with two inside surfaces and two ribs and includes a circumferential ring, as described above. One embodiment of the invention includes a membrane that extends radially outward onto the outer surface of the rim, and another embodiment includes a membrane that covers the container opening without extending radially outward onto the outer surface of the rim. Thus containers of the present invention may be sealed by interference-fits with the overcap when the membrane is attached and when the membrane is removed.

BRIEF DESCRIPTION OF THE SEVERAL VIEWS OF THE DRAWINGS

Figure 1:
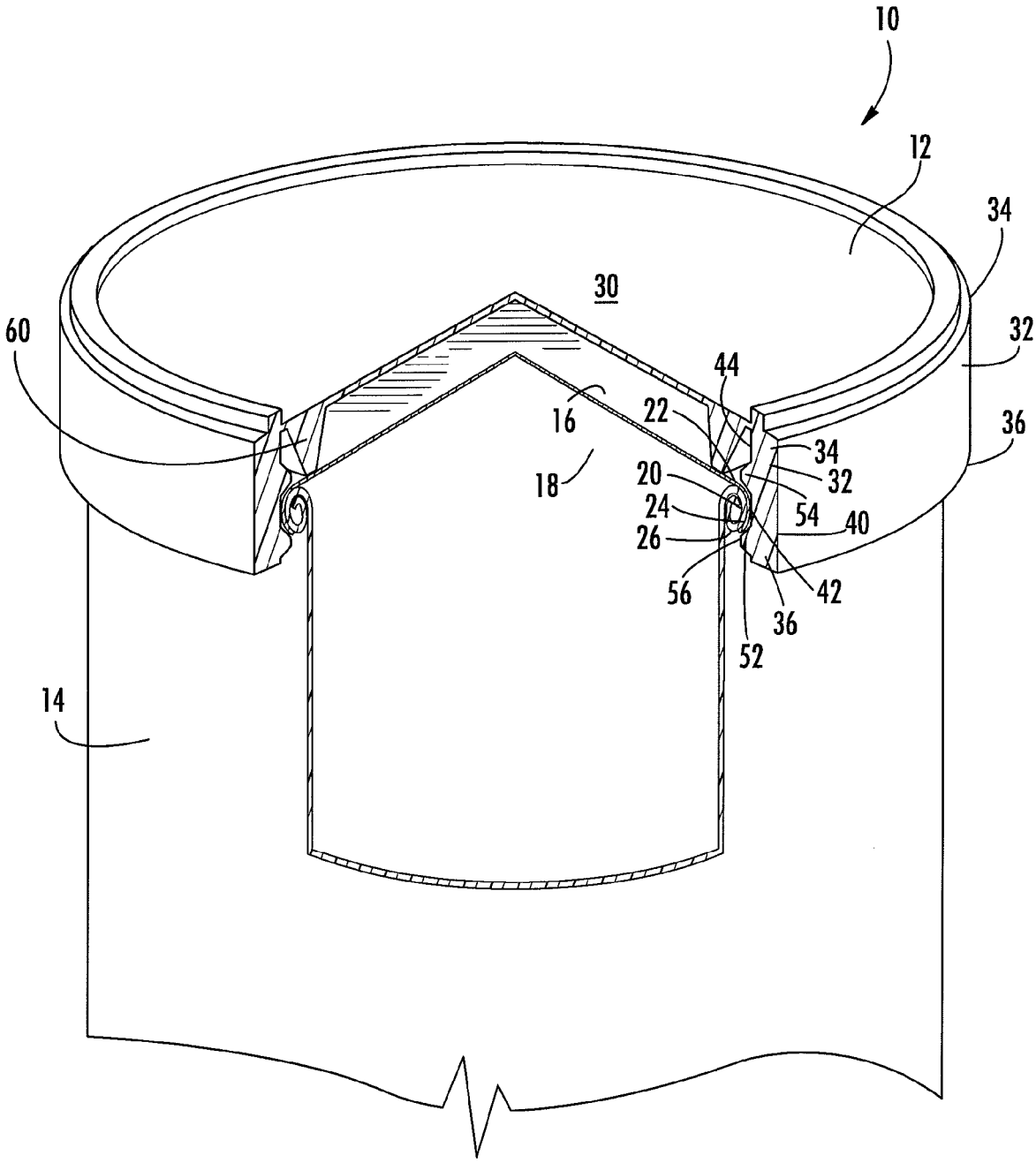
Figure 2:
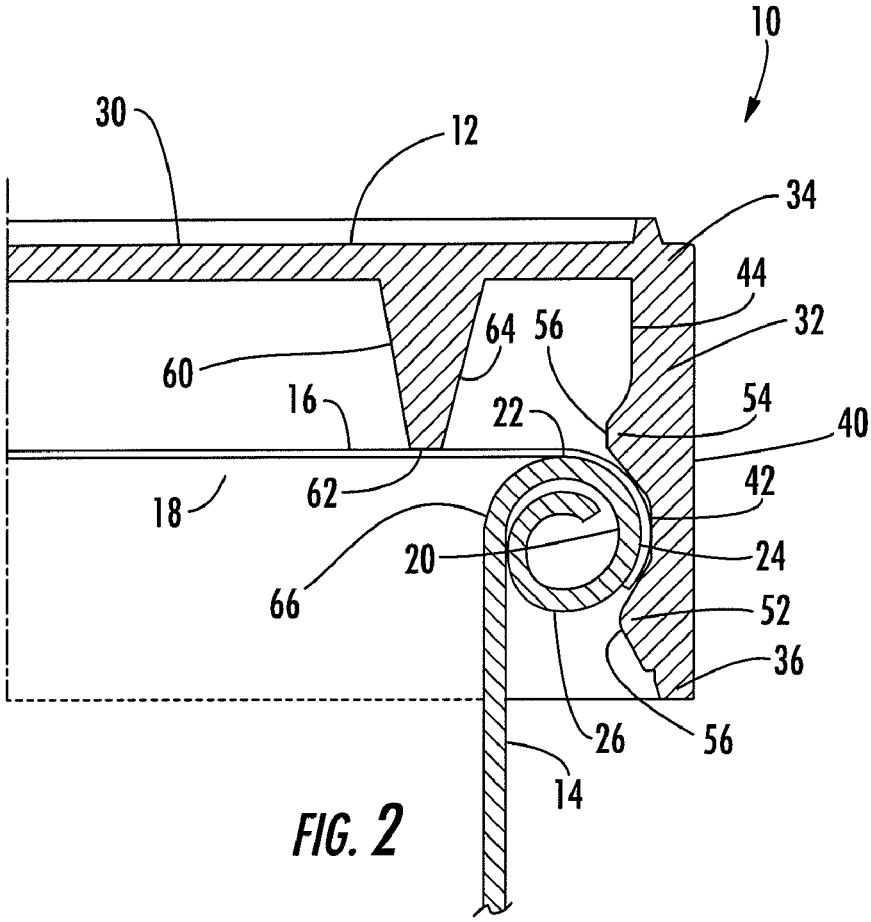
Figure 3:
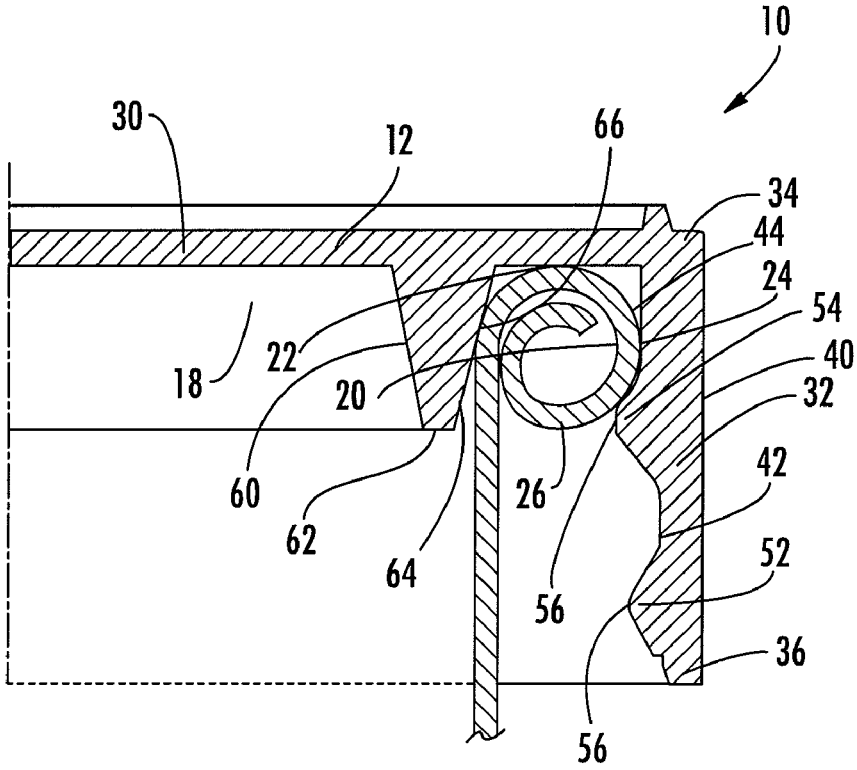

Having thus described the invention in general terms, reference will now be made to the accompanying drawings, which are not necessarily drawn to scale, and wherein:

FIG. 1 is a perspective view of a container having an overcap, partially in section, in accordance with an embodiment of the present invention;

FIG. 2 is a schematic, cross-sectional view of the container and overcap of FIG. 1 showing the first inside surface of the overcap engaging the membrane and the rim of the container to create an interference-fit and showing the distal end of the circumferential ring engaging the membrane; and FIG. 3 is a schematic, cross-sectional view of the container and overcap of FIG. 1 showing the second inside surface of the overcap engaging the rim of the container to create an interference-fit and the outside surface of the circumferential ring producing an interference-fit with the inner wall of the container.

DETAILED DESCRIPTION OF THE INVENTION

The present invention now will be described more fully hereinafter with reference to the accompanying drawings in which some but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

With reference to FIGS. 1-3, a sealable storage device in accordance with one embodiment of the invention is illustrated. The storage device 10 includes an overcap 12, a container 14, and a membrane 16. The container 14 is structured to store products within the container and to provide access to the stored products through an opening 18. A variety of products can be stored in the storage device 10; however, the storage device is preferably used to store perishable products, and accordingly the membrane 16 provides a barrier to seal the container 14.

The membrane 16 is removably attached to the container 14 during the packaging of the stored product. The membrane 16 substantially covers the entire opening 18 of the container 14 and minimizes or prevents the passage of oxygen, moisture, and/or other contaminants into the container. The membrane 16 must be removed, either completely or partially, to provide access to the product, during normal use of the storage device 10. After the membrane 16 has been removed, it generally cannot be reattached to seal the container 14, and is usually discarded.

The container 14 as illustrated in FIG. 1 is a cylindrical tube. Further embodiments of the invention may include containers, and corresponding overcaps 12, that are of any geometric shape. Thus, although terms such as diameter, circumferential, radial, and the like, are used herein, they are not intended to limit the invention to any particular configuration, but are merely used as descriptive terms. The container 14 of FIG. 1 includes the opening 18, which is encircled by a radially outwardly protruding rim 20. The rim 20 of the illustrated container 14 is an outwardly rolled bead. Other containers 14 of the present invention may include a rim 20 of any configuration. The rim 20 includes a top surface 22, an outer surface 24, and a bottom surface 26. The rim 20 of FIG. 1 has a generally consistent cross-section throughout the entire circumference of the container; however, other containers 14 of the present invention may include a rim that includes one or more features of varying cross-section. Such features may be included to facilitate removal of the overcap 12 or membrane 16.

The membrane 16 of FIGS. 1-3 is attached to both the top surface 22 and the outer surface 24 of the rim 20. Other embodiments of the storage device may include a membrane that is attached only to the top surface or that is attached to the top surface, the outer surface, and the bottom surface. The overcaps of such embodiments are structured and arranged to accommodate the membrane attached to the various surfaces to improve the fit between the overcap and the membrane and rim.

The overcap 12 of FIG. 1 includes a top panel 30 and a skirt 32. The top panel 30 is generally disk-shaped and defines a periphery 34 proximate the outer circumference of the top panel. The skirt 32 extends downward from the periphery 34 of the top panel 30. The overcap 12 of further embodiments of the storage device 10 may include features that are at a radial distance beyond the periphery 34 or above the top panel 30. Such features may include surfaces to facilitate the disconnecting or connecting of the overcap 12 and container 14. The skirt 32 of the illustrated overcap 12 extends generally perpendicular from the top panel 30 to a distal end 36. Other embodiments of the overcap 12 may include a skirt 32 that extends from the top panel 30 at a non-perpendicular angle.

The skirt 32 of FIG. 2 and FIG. 3 has an outside surface 40 and an inside surface facing the interior of the overcap. The inside surface of the skirt 32 includes a first inside surface 42 and a second inside surface 44. The first inside surface 42 is axially spaced apart from the top panel 30 and is proximate the distal end 36 of the skirt 32. The second inside surface 44 is axially positioned between the first inside surface 42 and the top panel 30. Furthermore, the skirt 32 includes a first rib 52 that projects inwardly from the inside surface of the skirt and is axially located between the first inside surface 42 and the distal end 36. The skirt 32 also includes a second rib 54 that projects inwardly from the inside surface of the skirt and is axially located between the second inside surface 44 and the first inside surface 42.

FIG. 2 illustrates the overcap 12 connected to the container 14 when the membrane 16 is attached to the container, and FIG. 3 illustrates the overcap connected to the container when the membrane has been removed. As shown in FIG. 2, the first inside surface 42 is diametrically dimensioned to produce an interference-fit with the membrane 16 and the rim 20. The inside diameter of the first inside surface 42 of the undeformed overcap 12 is generally less than the diameter of the outer surface 24 of the rim 20 added to twice the thickness of the membrane. This difference in diameter creates an interference-fit when the overcap 12 is pushed onto the top of the container. A slight growth in diameter of the overcap 12 and/or a slight reduction in diameter of the rim 20 and membrane 16 occurs through material deformation. Since the materials have resilience, they exert a restoring force, which tends to keep the overcap 12 attached. Other embodiments of the interference-fit overcap may create the interference-fit by having a friction-fit or an interference-fit between the membrane and/or a surface of the rim and the first inside surface of the skirt, between the membrane and/or a surface of the rim and the first rib, between the membrane and/or a surface of the rim and the second rib, or between any combination of the rim features and the skirt features.

As shown in FIG. 3, the second inside surface 44 is diametrically dimensioned to produce an interference-fit with the rim 20 alone. The inside diameter of the second inside surface 44 of the interference-fit overcap 12 is generally less than the diameter of the outer surface 24 of the rim 20. This difference in diameter creates the interference-fit. Other embodiments of the interference-fit overcap may create the interference-fit by having a friction-fit or an interference-fit between a surface of the rim and the second inside surface of the skirt, between a surface of the rim and the second rib, between a surface of the rim and the top panel, or between any combination of the rim features and the skirt features.

The ribs 52 and 54 of the overcap engage the rim 20 of the container 14 to resist detachment of the overcap from the container when the rim of the container is located axially above the respective rib. When the membrane 16 is attached and the membrane and rim 20 engage the first inside surface 42, the first rib 52 may contact the rim on the bottom surface 26, the outer surface 24, or some combination of both surfaces to resist detachment of the overcap 12 from the container 14. Likewise, when the membrane 16 is removed and the rim 20 engages the second inside surface 44, the second rib 54 may contact the rim on the bottom surface 26, the outer surface 24, or some combination of both surfaces to resist detachment of the overcap 12 from the container 14.

The overcap 12 of FIGS. 2 and 3 has a first rib 52 and a second rib 54 that each define a rounded portion 56 at the innermost surface of the rib. The rounded portion 56 of the first rib 52 and of the second rib 54 is the surface of the respective rib opposite the outside surface 40 of the skirt 32.

The rounded portion 56 of each rib facilitates the connecting and disconnecting of the overcap 12, while minimizing or preventing damage to the membrane 16 or the rim 20. The rounded portion 56 of the first rib 52 defines a diametrical distance relatively smaller than the inside diameter of the first inside surface 42. Therefore, when the overcap 12 is connected to the container 14, the skirt 32 of the overcap must flex outward and/or the rim 20 flex inward to allow passage of the membrane 16 and the rim past the first rib 52 and into the first inside surface, as shown in FIG. 2. Likewise, the rounded portion 56 of the second rib 54 has an inside diameter smaller than the inside diameter of the second inside surface 44. Therefore, when the overcap 12 is connected to the container 14, the skirt 32 of the overcap must flex outward and/or the rim 20 flex inward to allow passage of the rim past the first rib 52 and second rib 54 and into the first inside surface, as shown in FIG. 3.

The overcap 12 of FIG. 1 can be made of various materials that have sufficient flexibility and resilience to allow the necessary deformation of the overcap as it is pushed onto the container rim. Suitable materials include but are not limited to polyester, polyolefins (including homopolymers, co-polymers, etc.) such as polyethylene or polypropylene, polystyrene, elastomers (including thermoplastic rubber, thermoplastic elastomer, etc.), and mixtures or combinations thereof. The overcap 12 of the illustrated embodiment is made of a material that is sufficiently flexible and resilient to allow passage of the rim 20 of the container 14 through the first rib 52 and the second rib 54 of the overcap. An overcap 12 of a more rigid material may include a thin-wall portion in the top panel 30 or skirt 32 such that the rigid material is allowed to flex enough to allow passage of the rim 20 of the container 14 through the first rib 52 and the second rib 54 of the overcap.

Each of the ribs 52 and 54 of the overcap 12 of FIGS. 1-3 defines an uninterrupted circumferential rib to provide uniform retention of the overcap when the overcap is attached or connected to the container 14. Other embodiments of the overcap may include a first rib and/or a second rib that defines a plurality of circumferentially spaced portions. These spaced portions may be of equal circumferential width and spacing or may be of random or non-uniform width and spacing. Each of the portions of the plurality of circumferentially spaced portions defining a single rib are all located at an equivalent axial distance from the top panel, so that when the overcap is attached to the container, the top panel is generally parallel to the plane in which the top surface 22 of the rim 20 lies.

The overcap 12 of FIGS. 1-3 also includes a circumferential ring 60 extending from the lower surface of the top panel 30 in the same direction as the skirt 32, which in the illustrated embodiment is downward from the top panel. The circumferential ring 60 is also located radially inward of the skirt 32. The circumferential ring 60 of the illustrated embodiment defines a ring of continuous cross-section; however, further embodiments of the present invention include circumferential rings with alternative cross-sections and/or cross-sections that change as the ring extends circumferentially, to describe two non-limiting ways in which the circumferential ring may vary from the illustrated embodiment. Additionally, the ring may be a continuous ring about the circumference, or may be discontinuous, e.g., a plurality of circumferentially spaced segments about the circumference. Referring again to FIG. 2, the circumferential ring 60 defines a distal surface 62 that is axially opposite the top panel 30. The distal surface 62 of the circumferential ring 60 of FIGS. 1-3 is axially positioned to engage a top surface of the membrane 16 when the overcap 12 is positioned on the container 14 such that the first rib 52 engages beneath the rim 20 of the container, as shown in FIG. 2. By engaging the top surface of the membrane 16 when the overcap 12 is attached to the container 14, the circumferential ring 60 provides additional resistance to any downward axial forces applied to the overcap 12 that may cause the second rib 54 to move axially downward around the rim 20, which would potentially damage the rim (and thus decrease the likelihood that a seal could be formed on the rim) given the diametrical dimension of the second rib and the combined diameter of the rim and twice the thickness of the membrane, as discussed above. Further embodiments of the present invention include distal ends of the circumferential ring that are of alternative axial dimensions that may or may not cause the circumferential ring to engage a top surface of the membrane when the overcap is positioned on the container such that the first rib engages beneath the rim of the container.

The circumferential ring 60 also defines an outside surface 64 on a radially outermost portion of the circumferential ring, as shown in FIGS. 2 and 3. The outside surface 64 is diametrically dimensioned to define a diameter that is greater than the diameter of an inner wall 66 of the container 14 that the outside surface of the circumferential ring 60 engages when the overcap 12 is engaged with the container 14 after the membrane has been removed and when the second rib 54 engages beneath the rim 20 of the container, as shown in FIG. 3. The circumferential ring 60 is arranged to extend into the opening 18 when the overcap 12 is so engaged. The container opening 18 is defined by the inner wall 66 in the illustrated embodiment. Because the outside surface 64 of the circumferential ring 60 defines a greater diameter than the inner wall 66 at the location(s) where the two contact one another, the circumferential ring 60 produces an interference-fit with the inner wall of the container after the membrane 16 has been removed from the container. Therefore, the overcap 12 of the present invention provides an interference-fit in at least two locations (on the inner wall of the container and on the rim) when the overcap is inserted after the membrane has been removed to thereby provide a seal of increased reliability and effectiveness.

The outside surface 64 of the circumferential ring 60 of the illustrated embodiments of the present invention defines a surface that is generally angled relative to the axis (or axial direction) of the container 14. The angled outside surface 64 is structured to provide a lead-in to assist in positioning the rim 20 against the second inside surface 44 of the skirt 32 when the overcap 12 is inserted onto the container 14 and to insure an interference-fit is created with the inner wall 66. Further embodiments of the present invention include an angled outside surface of the circumferential ring that is structured to coincide with an angle of an inner wall of the container such that when the overcap is inserted, the circumferential ring produces the interference-fit with the inner wall of the container. Further embodiments of the present invention define outside surfaces and inner walls at alternative angles, that define curved surfaces, or that are both axially aligned with the axis of the container or opening. Still further embodiments of the present invention include surface texturing or additional components on the outside surface and/or inner wall to enhance the interference-fit and the resulting seal.

The membrane 16 can be manufactured from any suitable material or combinations of two or more different materials, and can be removably attached by any suitable adhesive or process. The membrane 16 of the illustrated storage device 10 is a metal foil that is joined with adhesive to a container 14 that is a paperboard tube. Where moisture and/or gas barrier performance is required of the membrane, the membrane can comprise various barrier materials, including but not limited to metal foil, polyethylene terephthalate, metallized polyethylene terephthalate, polyethylene naphthalate, metallized polypropylene, metal oxide and silicate coated polyester, metal oxide and silicate coated polypropylene, ethylene vinyl alcohol copolymer, and mixtures thereof. Instead of or in addition to a barrier layer of such materials, the membrane can include one or more layers of other materials such as polyester, polyolefin, and others. The membrane 16 can be adhered to the container by various materials, including but not limited to glues or adhesives such as hot melt glues, ethylene vinyl acetate, ethyl methyl acrylate, metallocenes, and the like, heat seal materials such as ionomers (e.g., SURLYN®, TRANCEND®, or the like), polypropylene (with or without mineral filler), high-density polyethylene, low-density polyethylene, and others. The container itself can be formed of various materials and by various processes including but not limited to spiral winding of composite materials, convolute winding of composite materials, injection molding, blow molding, or thermoforming a suitable polymer material, and others.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An interference-fit overcap for engaging a radially outwardly protruding rim of a container having a removably attached membrane, wherein the container defines an opening encircled by an inner wall of the container, the overcap comprising:

a top panel having a periphery;

a skirt extending from the periphery of the top panel to a distal end such that the skirt defines a first inside surface axially spaced from the top panel proximate the distal end of the skirt and defines a second inside surface axially positioned between the first inside surface and the top panel, wherein the first inside surface is diametrically dimensioned to produce an interference-fit with the membrane and rim and the second inside surface is diametrically dimensioned to produce an interference-fit with the rim alone;

a first rib projecting inwardly from the skirt and axially located between the first inside surface of the skirt and the distal end of the skirt;

a second rib projecting inwardly from the skirt and axially located between the second inside surface and the first inside surface; and a circumferential ring extending from the top panel in a same direction as the skirt extends and located radially inward of the skirt, wherein the circumferential ring defines an outside surface on a radially outermost portion of the circumferential ring;

wherein the first rib engages beneath the rim of the container to resist detachment of the overcap when the membrane is attached and the second rib engages beneath the rim of the container to resist detachment of the overcap when the membrane is not attached;

wherein the outside surface of the circumferential ring is diametrically dimensioned to produce an interference-fit with the inner wall of the container when the second rib engages beneath the rim of the container, and wherein the circumferential ring comprises a distal surface opposite the top panel and axially positioned to engage the membrane when the first rib engages beneath the rim of the container, such engagement of the circumferential ring with the membrane providing resistance to downward movement of the skirt that would cause the second rib to engage beneath the rim of the container.

2. An interference-fit overcap according to claim 1, wherein the radially outwardly protruding rim encircling the container defines an outer surface and the membrane extends radially outward onto the outer surface of the rim.

3. An interference-fit overcap according to claim 1, wherein the radially outwardly protruding rim encircling the container defines an outer surface and the membrane covers the container opening without extending radially outward onto the outer surface of the rim.

4. An interference-fit overcap according to claim 1, wherein the first rib and the second rib each defines an uninterrupted circumferential rib.

5. An interference-fit overcap according to claim 1, wherein the first rib and the second rib each defines a plurality of circumferentially spaced portions.

6. An interference-fit overcap according to claim 1, wherein the skirt extends substantially perpendicular to the top panel of the overcap.

7. An interference-fit overcap according to claim 1, wherein the first rib and the second rib of the overcap each define a rounded edge portion at a radially inward surface opposite the outside surface of the skirt.

8. An interference-fit overcap according to claim 7, wherein the rounded edge portion of the first rib defines an inside diameter relatively larger than an inside diameter of the rounded edge portion of the second rib.

9. An interference-fit overcap according to claim 1, wherein the overcap is a thermoplastic material.

10. A container, comprising:

a container body formed by a wall, wherein the wall defines an opening encircled by a radially outwardly protruding rim;

a removably attached membrane substantially covering the opening while the membrane is attached; and an interference-fit overcap, comprising:

a top panel having a periphery;

a skirt extending from the periphery of the top panel to a distal end such that the skirt defines a first inside surface axially spaced from the top panel proximate the distal end of the skirt and defines a second inside surface axially positioned between the first inside surface and the top panel, wherein the first inside surface is diametrically dimensioned to produce an interference-fit with the membrane and rim and the second inside surface is diametrically dimensioned to produce an interference-fit with the rim alone;

a first rib projecting inwardly from the skirt and axially located between the first inside surface of the skirt and the distal end of the skirt;

a second rib projecting inwardly from the skirt and axially located between the second inside surface and the first inside surface; and a circumferential ring extending from the top panel in a same direction as the skirt extends and radially inward of the skirt, wherein the circumferential ring defines an outside surface on a radially outermost portion of the circumferential ring;

wherein the first rib engages beneath the rim of the container to resist detachment of the overcap when the membrane is attached and the second rib engages beneath the rim of the container to resist detachment of the overcap when the membrane is not attached;

wherein the outside surface of the circumferential ring is diametrically dimensioned to produce an interference-fit with the inner wall of the container when the second rib engages beneath the rim of the container, and wherein the circumferential ring comprises a distal surface opposite the top panel and axially positioned to engage the membrane when the first rib engages beneath the rim of the container, such engagement of the circumferential ring with the membrane providing resistance to downward movement of the skirt that would cause the second rib to engage beneath the rim of the container.

11. A container according to claim 10, wherein the radially outwardly protruding rim encircling the container defines an outer surface and the membrane extends radially outward onto the outer surface of the rim.

12. A container according to claim 10, wherein the radially outwardly protruding rim encircling the container defines an outer surface and the membrane covers the container opening without extending radially outward onto the outer surface of the rim.

13. A container according to claim 10, wherein the outwardly protruding rim is an outwardly rolled bead.

14. A container according to claim 10, wherein the first rib and the second rib each defines an uninterrupted circumferential rib.

15. A container according to claim 10, wherein the first rib and the second rib each defines a plurality of circumferentially spaced portions.

16. A container according to claim 10, wherein the skirt extends substantially perpendicular to the top panel of the overcap.

17. A container according to claim 10, wherein the first rib and the second rib of the overcap each define a rounded edge portion at a radially inward surface opposite the outside surface of the skirt.

18. A container according to claim 17, wherein the rounded edge portion of the first rib defines an inside diameter relatively larger than an inside diameter of the rounded edge portion of the second rib.

19. A container according to claim 10, wherein the membrane defines a thickness and the inside diameter of the first inside surface is approximately equivalent to a combined distance of the inside diameter of the second inside surface and twice the thickness of the membrane.

20. A container according to claim 10, wherein the membrane is a metal foil.

21. A container according to claim 10, wherein the overcap is a thermoplastic material.

22. A sealable storage device, comprising:

a container, comprising:

a body formed by a wall, an opening defined by the wall, and an outwardly rolled bead encircling the opening of the container, wherein the bead protrudes generally outward from the wall and defines an outer surface;

a membrane removably attached to the bead such that the membrane substantially covers the opening and extends radially outward onto the outer surface of the bead while the membrane is attached; and an interference-fit overcap, comprising:

a top panel having a periphery;

a skirt extending from the periphery of the top panel to a distal end such that the skirt defines a first inside surface axially spaced from the top panel proximate the distal end of the skirt and defines a second inside surface axially positioned between the first inside surface and the top panel, wherein the first inside surface is diametrically dimensioned to produce an interference-fit with the membrane and bead and the second inside surface is diametrically dimensioned to produce an interference-fit with the bead alone;

a first rib projecting inwardly from the skirt and axially located between the first inside surface of the skirt and the distal end of the skirt;

a second rib projecting inwardly from the skirt and axially located between the second inside surface and the first inside surface; and a circumferential ring extending from the top panel in a same direction as the skirt extends and radially inward of the skirt, wherein the circumferential ring defines an outside surface on a radially outermost portion of the circumferential ring;

wherein the first rib engages beneath the bead of the container to resist detachment of the overcap when the membrane is attached and the second rib engages beneath the bead of the container to resist detachment of the overcap when the membrane is not attached;

wherein the outside surface of the circumferential ring is diametrically dimensioned to produce an interference-fit with the inner wall of the container when the second rib engages beneath the rim of the container, and wherein the circumferential ring comprises a distal surface opposite the top panel and axially positioned to engage the membrane when the first rib engages beneath the rim of the container, such engagement of the circumferential ring with the membrane providing resistance to downward movement of the skirt that would cause the second rib to engage beneath the rim of the container.

* * * * *